US005313903A

United States Patent [19]

Goldbach et al.

[11] Patent Number: 5,313,903

[45] Date of Patent: May 24, 1994

[54] METHOD AND APPARATUS FOR FABRICATING DOUBLE-WALLED VESSEL HULL MIDBODY MODULES

[75] Inventors: Richard A. Goldbach; Frank E. McConnell, both of Norfolk, Va.; J. Richard Salzer, Sugar Land, Tex.

[73] Assignees: Metro Machine Corp., Norfolk, Va.; Marinex International, Inc., Hoboken, N.J.

[21] Appl. No.: 95,178

[22] Filed: Jul. 23, 1993

[51] Int. Cl.[5] ..... B63B 3/02

[52] U.S. Cl. ..... 114/65 R; 114/77 R

[58] Field of Search ..... 114/65 R, 72, 77 R, 114/78, 222, 83, 85, 88; 29/429, 428

[56] References Cited

U.S. PATENT DOCUMENTS

| | | | |
|---|---|---|---|
| 3,872,815 | 3/1975 | Kawai et al. | 114/65 R |
| 3,875,887 | 4/1975 | Fittrip et al. | 114/65 R |
| 3,886,883 | 6/1975 | Odaka | 114/65 R |
| 4,003,326 | 1/1977 | Horii et al. | 114/65 R |
| 4,491,081 | 1/1985 | Ivanov | 114/65 R |
| 4,712,499 | 12/1987 | Haruguchi et al. | 114/65 R |
| 5,085,161 | 2/1992 | Cuneo | 114/65 R |
| 5,086,723 | 2/1992 | Goldbach et al. | 114/78 |
| 5,090,351 | 2/1992 | Goldbach et al. | 114/65 R |

*Primary Examiner*—David M. Mitchell
*Assistant Examiner*—Stephen P. Avila
*Attorney, Agent, or Firm*—Cushman Darby & Cushman

[57] ABSTRACT

The fixtures in which curved and reinforced flat plates are held while being welded, cleaned, coated and cured include fixedly mounted exterior towers and interior towers removably mounted on rollable bogies (i.e., rail cars or carriages) for ease of transport through a succession of work stations. Subcomponents fabricated on respective bogies are weldingly joined to form module subassemblies after coupling and maneuvering the respective bogies to align the subcomponents (i.e., units). A transverse bulkhead is supported on fluid cushion pallets beside the bogie-supporting rails, so that the transverse bulkhead can be positioned for welding of each subassembly thereto, to provide each respective double-walled vessel hull midbody module.

16 Claims, 13 Drawing Sheets

METHOD AND APPARATUS FOR FABRICATING DOUBLE-WALLED VESSEL HULL MIDBODY MODULES

BACKGROUND OF THE INVENTION

The U.S. Pat. No. of Cuneo et al. 5,085,161, issued Feb. 4, 1992, discloses a method and an apparatus for fabricating from steel plate subassemblies which are joined to one another and to transverse bulkheads to provide modules which are then serially joined to provide a longitudinal midbody for a double-walled tanker hull. Bow and stern sections are added to complete the hull. According to the method disclosed in this prior patent, much of the fabrication of the subassemblies is conducted using a set of towers which hold and position the various curved plates of the inner and outer hulls, and the wall-connecting plates, all arranged on end, as electrogas or electroslag welders vertically create T-joints among the respective sets of three juxtaposed plate edges.

The U.S. Pat. No. of Goldbach et al. 5,090,351, issued Feb. 25, 1992, discloses certain improvements, e.g., for bending the curved plates, and welding, cleaning, painting and assembling the various elements of the modules and for serially joining the modules to provide the longitudinal midbodies.

The U.S. Pat. No. of Goldbach et al. 5,086,723, issued Feb. 11, 1992, discloses an elaborated double-hulled vessel, in which each midbody module further includes a double-walled longitudinal bulkhead which can be fabricated as a subassembly using the methods and apparatus disclosed in the aforementioned U.S. Pat. Nos. of Cuneo et al. 5,085,161 and Goldbach et al. 5,090,351. An improved form of the longitudinal bulkhead (and other subassemblies of the double-walled vessel hull), which provides longitudinally staggered cell-to-cell access openings through the longitudinal wall layer-connecting plates is disclosed in the U.S. patent application No. of Goldbach 07/953,141, filed Sep. 29, 1992.

According to a further development that is disclosed in the copending U.S. patent application No. of Goldbach et al. 07/818,588, filed Jan. 2, 1992, the newly fabricated modules are turned from their initially upended orientation to an upright orientation using a two-section floating drydock. One section is equipped with the module-rotating device. The two drydock sections can be independently flooded and pumped out for acquiring modules and shifting the growing midbody so as to spatially position the site where two modules are to be joined so that it is effectively between the two sections. Therefore, the drydock sections can be adjusted in several degrees of freedom relative to one another for correctly matching the module ends which are to be welded. Also in this prior document, there is disclosed the concept of building the midbody in two multiple-module portions, one having the bow section joined at one end, and the other having the stern section joined at the opposite end. These two complementary vessel hull portions are then joined to complete the hull.

For use in instances where a flat hull surface is desired, such as for the inner wall of the bottom of a cargo vessel hull, the concepts embodied in the abovementioned earlier patent documents can be modified to provide all or a portion of either wall layer of the double-walled vessel hull to be made of flat rather than curved plates, as disclosed in the U.S. patent application No. of Goldbach 08/033,357, filed Mar. 18, 1993.

Having now given more thought to the overall process and to the apparatus used for fabricating the plates, subassemblies, modules, midbodies and vessel hulls, the present inventors have devised some improvements particularly for practicing an intermediate part of the process. For those following the process as described in the aforementioned U.S. Pat. No. of Goldbach et al. 5,090,351, the improvements provided by the present invention come into play at a stage after the curved and stiffened flat panels have been fabricated and painted, preferably using the cathodic epoxy coating system which is described at that patent. After the modules are fabricated from those panels using the improved process and apparatus of the invention, the modules can be serially joined using the methods and apparatus disclosed in any of Cuneo et al. U.S. Pat. No. 5,085,161, Goldbach et al. U.S. Pat. No. 5,090,351 and Goldbach et al. U.S. Pat. No. 07/818,588.

SUMMARY OF THE INVENTION

The fixtures in which curved and reinforced flat plates are held while being welded, cleaned, coated and cured include fixedly mounted exterior towers and interior towers removably mounted on rollable bogies (i.e., rail cars or carriages) for ease of transport through a succession of work stations. Subcomponents fabricated on respective bogies are weldingly joined to form module subassemblies after coupling and maneuvering the respective bogies to align the subcomponents (i.e., units). A transverse bulkhead is supported on fluid cushion pallets beside the bogie-supporting rails, so that the transverse bulkhead can be positioned for welding of each subassembly thereto, to provide each respective double-walled vessel hull midbody module.

The improved method can provide several advantages. For instance, in the typical practice of the improved method, no crane lifts over eight tons are required; after the curved and stiffened flat panels for a unit are installed on the carriage fixture, no other crane lifts are required and a building having about sixty feet of headroom can be used for sheltering production, up to the point of final assembly of the subassemblies to the transverse bulkhead to provide the modules; alignment of units and subassemblies is simplified, respectively, during fabrication of subassemblies and modules; coating of vertical welds is simplified; costs for assembling, welding, coating subassemblies and assembling modules is simplified; and collection of potential air pollutants while welding points, and coating and curing joint coatings is facilitated.

The present inventors are conditioned to conceptualize their invention in terms of the plates that make up the inner and outer (or two opposite) wall surfaces as being arcuate. This is despite the fact that the principles of the invention are actually applicable to instances where both walls are made of arcuately curved plates, where one is made of arcuately curved plates and the other is made of planar (flat) plates and where both are made of planar (flat) plates. Therefore, unless the contrary is evident from the context, when the inventors refer to "curved" plates herein, they intend to encompass not only arcuately curved plates, but also planar plates.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

Figure 1:
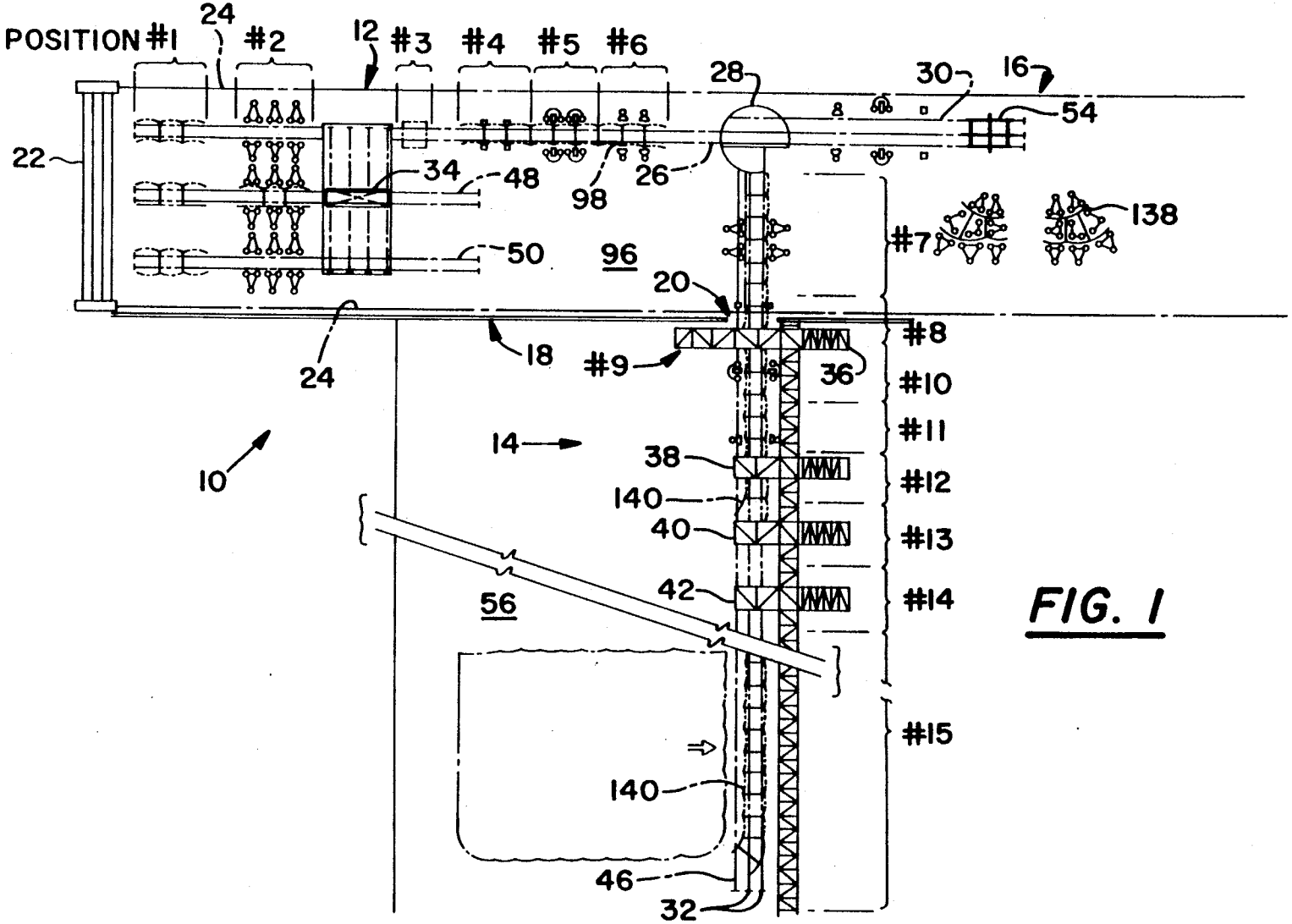
FIG. 1 is a schematic plan view of a preferred embodiment of a production facility for fabricating double-walled vessel hull midbody modules using the principles of the present invention.

FIG. 1 shows schematically in top plan view a preferred layout of successive work stations for fabricating subcomponents, subassemblies and modules in accordance with the principles of the present invention. The subcomponents are produced by welding plates together. Subcomponents are welded together to create subassemblies, and subassemblies are welded to one another and to transverse bulkheads to create modules. The modules are welded together end-to-end to create longitudinal midbodies for double-walled vessel hulls, e.g., for double-bottomed tankers. Neither the upstream steps for preparing the plates which are to be welded together to produce the subcomponents, nor the downstream steps for welding the modules together end-to-end to create the longitudinal midbodies are part of the present invention; those steps may be carried out using the materials, procedures and equipment that is disclosed in the respective parts of Cuneo et al. U.S. Pat. No. 5,085,161, Goldbach et al. U.S. Pat. No. 5,090,351 or Goldbach et al. U.S. patent application No. 07/818,588, filed Jan. 2, 1992. In other words, the present invention deals with a central segment of the production process.

In the central segment that is depicted in FIG. 1, plates are loaded on bogies at work station #1, T-joint welds are made at work station #2 thereby fabricating the plates into subcomponents. Possibly, interior fixture towers are lifted out of the subcomponent at work station #3 (or, if they remain in place, as is currently preferred, they are lifted out at work station #9). At work station #4, T-joints are externally blast cleaned; at work station #5 the externally cleaned T-joints are externally coated (painted); and at work station #6, the externally cleaned and painted T-joints have their coatings cured.

Between work stations #6 and #7, a turntable is provided at which the main assembly line turns at a right angle. In the subsidiary branch shown at the right, "corner" subcomponents are manufactured using a similar succession of steps. These will be incorporated in the subassemblies at work station #7.

At work station #7, subcomponents produced in the left branch of the main assembly line are serially joined, with corner subcomponents joined at respective ends, to create subassemblies (as that term is used in the aforementioned prior U.S. patents of Cuneo et al. U.S. Pat. No. 5,085,161, Goldbach et al. U.S. Pat. No. 5,090,351 and Goldbach et al. U.S. patent application No. 07/818,588).

At work stations #8, #10 and #11, the joints produced in work station #7 are externally blast cleaned, coated, and these coatings cured.

At work stations #12, #13 and #14, the joints produced in work stations #2 and #7 are internally blast cleaned, coated and these coatings cured.

At work station #15, the subassemblies fabricated and finished in work stations #7, #8, #10, #11, #12, #13, and #14 are assembled by welding to a transverse bulkhead and to one another, thereby creating an upended module closed at the bottom by a transverse bulkhead. This module is ready to be floated away and turned and serially joined to previously manufactured modules, for creating a double-walled vessel hull midbody, e.g., as disclosed in the aforementioned prior U.S. Pat. No. of Cuneo et al. 5,085,161, Goldbach et al. U.S. Pat. No. 5,090,351 or Goldbach et al. U.S. patent application No. 07/818,588.

Figure 19:
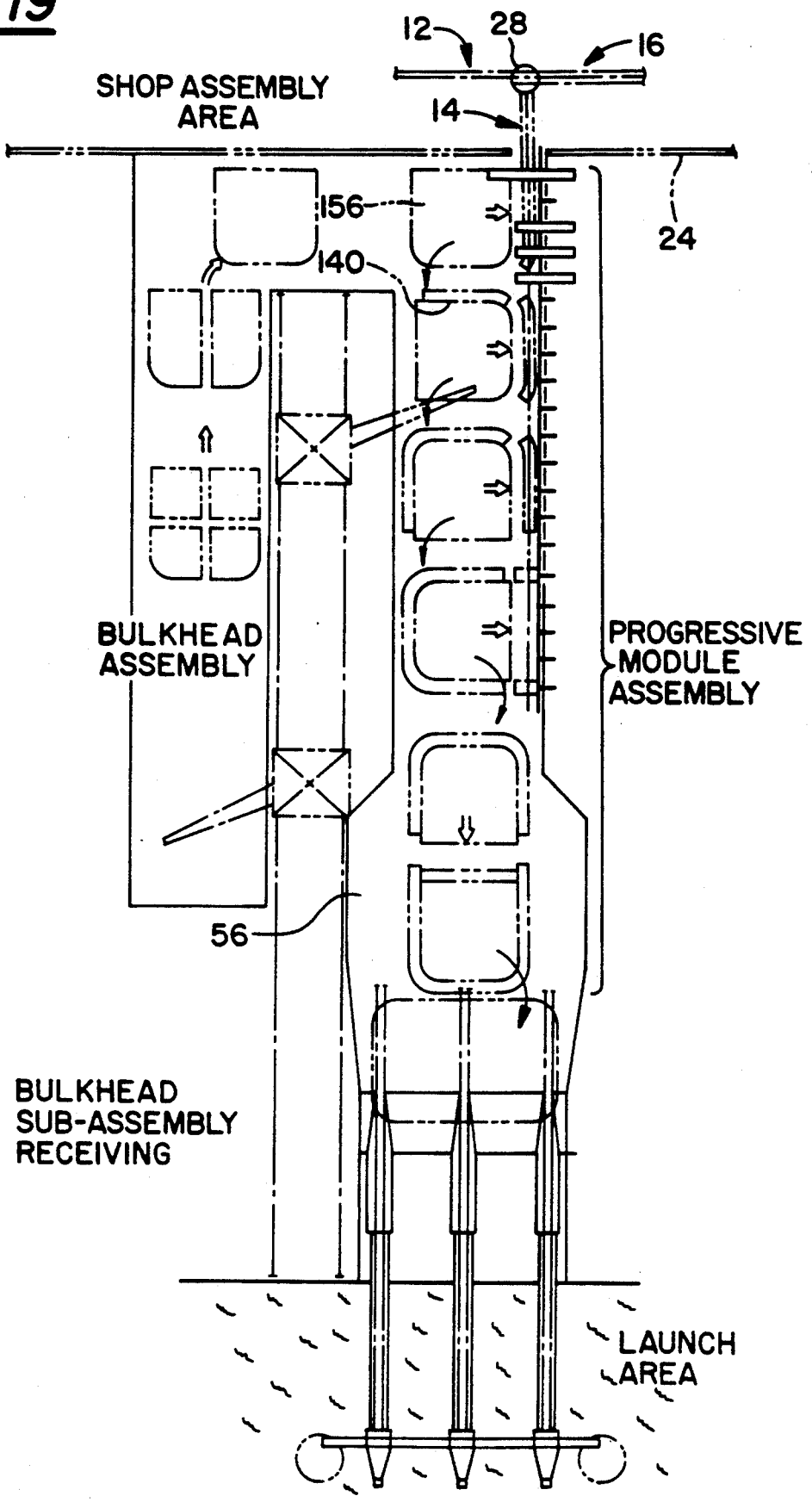
FIG. 19 is a schematic plan view of a portion of the production facility shown in FIG. 1, but showing in more detail the progressive assembly of modules at work stations #8 through #15, and the launch area where completed modules are launched into the adjacent body of water.

By preference, the left and right branches of the assembly line, and the center leg through work station #7 take place inside a building which may have as little as about sixty feet of headroom (for producing subassemblies that are fifty-four feet in length (i.e., in height as fabricated upended). After work station #7, the rails on which the bogies roll, go out a door onto a concrete pad, where work stations #8 through #15 are disposed largely or completely in the open, and at least with greater headroom. The proximity of a body of water to which completed modules are moved also is indicated in FIG. 19.

(For review, the theory of the production system that is embodied in the layout shown in FIG. 1, is that the longitudinal structure of each module will be built from plates as subcomponents, which are assembled to one another to provide subassemblies, which, in turn, are assembled to a transverse bulkhead and to one another to provide a module. Downstream of the process of the present invention, the modules are assembled to one another to provide a longitudinal midbody, and to bow and stern sections to provide a double-walled vessel hull. The input to work station #1 is panels or plates that will become inner or outer wall surfaces of the hull or of left or right walls of longitudinal bulkheads of the type disclosed in the aforementioned U.S. patent application No. of Goldbach 07/953,141, filed Sep. 29, 1992, and so-called stiffened flat panels, the plates which will extend between and structurally interconnect the two walls. All these panels have been cut to size, shaped, cleaned and coated and the coatings cured before entering work station #1, e.g., preferably by using the processes, apparatus and materials which are disclosed in Goldbach et al. U.S. Pat. No. 5,090,351. In general, the panels are made of steel plate, and the coatings are cured epoxy resin. As welded joints are made, some coating is destroyed on each panel adjacent the joint. Some of the process disclosed has as its objective providing, or reproviding the coating on and beside the joints, both externally of and internally of the subcomponents, subassemblies or modules.

The stiffened-flat panels are stiffened by having transversally extending kick-plate stiffener plates welded to them at periodic intervals.

In the course of the following discussion, exterior and interior towers for holding panels as they are welded to one another, and welding machines for forming T-joints among respective sets of three panel edges will be mentioned. The details of these devices may be substantially the same as those which are disclosed in Cuneo et al. U.S. Pat. No. 5,085,161 and Goldbach et al. U.S. Pat. No. 5,090,351.)

In FIG. 1, an assembly line 10 for producing double-walled vessel hull midbody modules from steel plates is shown including a left main arm 12 which extends from the upper left to the upper center of the figure, a main central arm 14 which extends from the upper center to the lower center of the figure, and a right auxiliary arm 16 which extends from the upper right, to the upper center of the figure. Work stations #1 through #6 are on the arm 12, and work stations #7 through #15 are on the arm 14.

Preferably the arms 12 and 14, and arm 16 through work station #7 are located under cover, e.g., in a building having at least about sixty feet of headroom for producing modules which, when upended, are fifty-four feet high. All of the assembly line preferably is sited on a firm foundation, e.g., a concrete pad which is well able to support the weight and concentrations of weight to which it can be reasonably expected to be subjected in normal intended use.

The building which provides cover for the preferably covered portion of the assembly line is shown represented by a side wall 18 having a portal 20 out through which the arm 16 extends, between work stations #7 and #8.

The assembly line portions under cover are shown served by an overhead bridge crane 22 which can travel, reversibly, from left to right, along rails schematically illustrated by phantom lines at 24. (In fact, the assembly line 10 preferably extends further to the left, for accomplishing preliminary plate-production tasks that are shown and described in Cuneo et al. U.S. Pat. No. 5,085,161, Goldbach et al. U.S. Pat. No. 5,090,351, and Goldbach et al. U.S. patent application No. 07/818,588, filed Jan. 2, 1992, to which reference may be made by those interested.)

The assembly line 10 is shown including a first set of bogie rails 26 which extend through the work stations #1 through #6, intersect a rotary turntable 28 and continue to the right end of the auxiliary right arm 16 of the assembly line 10. Inasmuch as double-width bogies are needed in the auxiliary right arm 16, a further rail 30 is provided parallel to the rails 26 in the arm 16, and extending onto the rotary turntable 28.

A further set of bogie rails 32 extends from the turntable 28, through work station #7, out the portal 20, and through work stations #8 through #15. Additional lateral transfer and/or lifting and lowering devices are provided where needed, e.g., as represented by the elements depicted between work stations #2 and #3 at 34, in work station #8 at 36, in work station #12 at 38, in work station #13 at 40, and work station #14 at 42.

Figure 16:
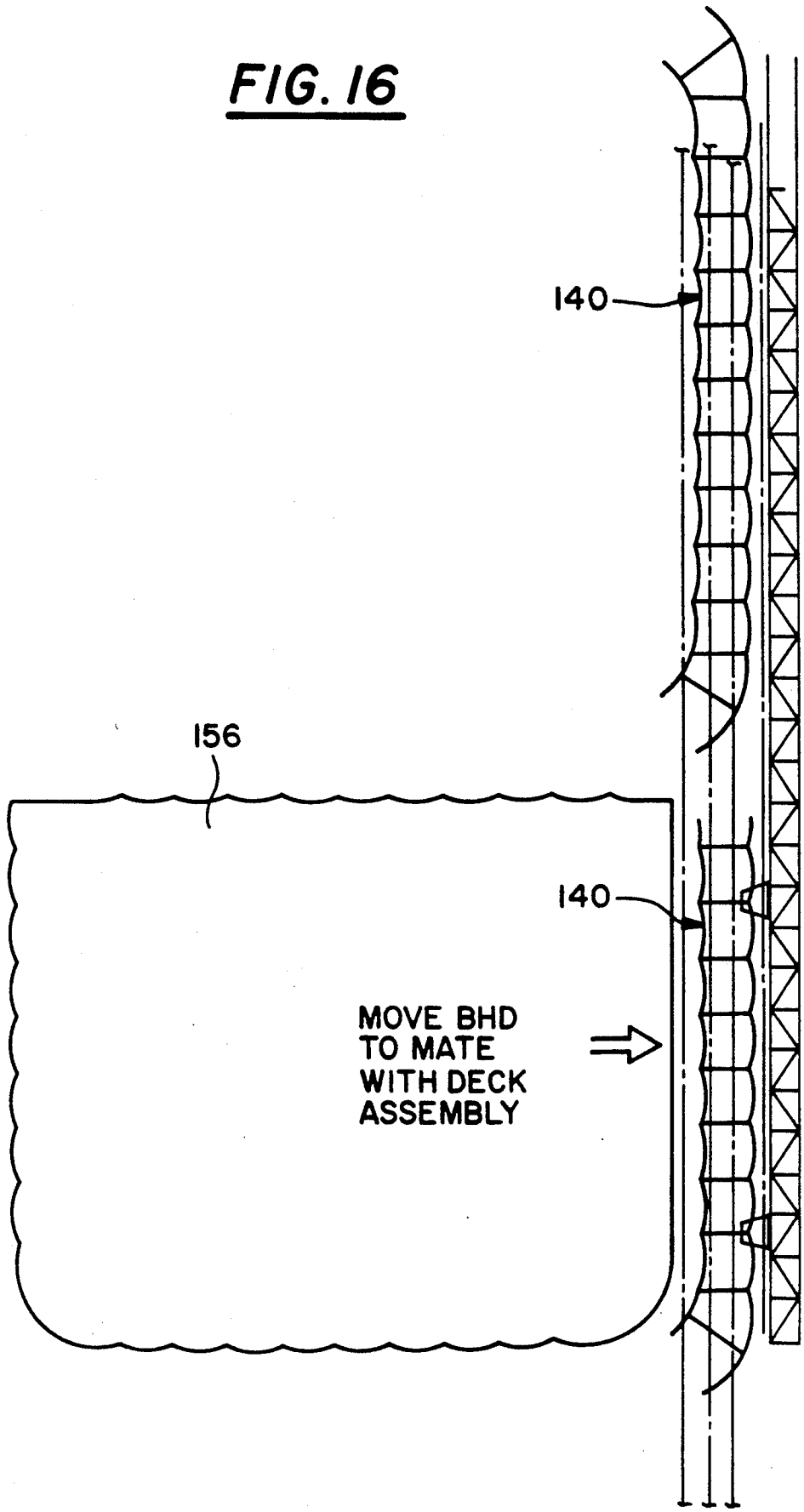
FIG. 16 is a schematic elevational view showing assembly of subassemblies of a transverse bulkhead at work station #15.

Shown extending parallel to the bogie rail set 32 along the work stations #8 through #15, is a support structure 44 for travelling guides 46 (FIG. 16) the purpose of which is to stabilize and regulate movement of growing subassemblies for modules.

Extending through work stations #1 through #3, or further, are one or more further sets of bogie rails 48, 50 which are parallel to but spaced laterally from the set of bogie rails 26 in order to provide an off-line buffer for increasing throughput of the respective work stations, allowing some work to be done in batches, providing for hold-up to accommodate downstream bottlenecks in production, etc. Similar buffers can be provided wherever needed. The transfer device 34 is adapted for transferring work and/or work on bogies laterally from line-to-line among the rail lines 26, 48 and 50.

The rail lines 26, 48, 50 and 32 and the turntable 28 are arranged to support single-width bogies; the rail line 26 within the right arm 16, as augmented by the rail 30 and the turntable 28 are arranged to support not only single-width bogies 52, but also double-width bogies 54.

The region 56 shown to the left from work stations #8 through #15 is a concrete pad on which transverse bulkheads may be fabricated (or to which they may be transferred, if fabricated elsewhere), for assembly of double-walled vessel hull module subassemblies thereto at work station #15.

Figure 17:
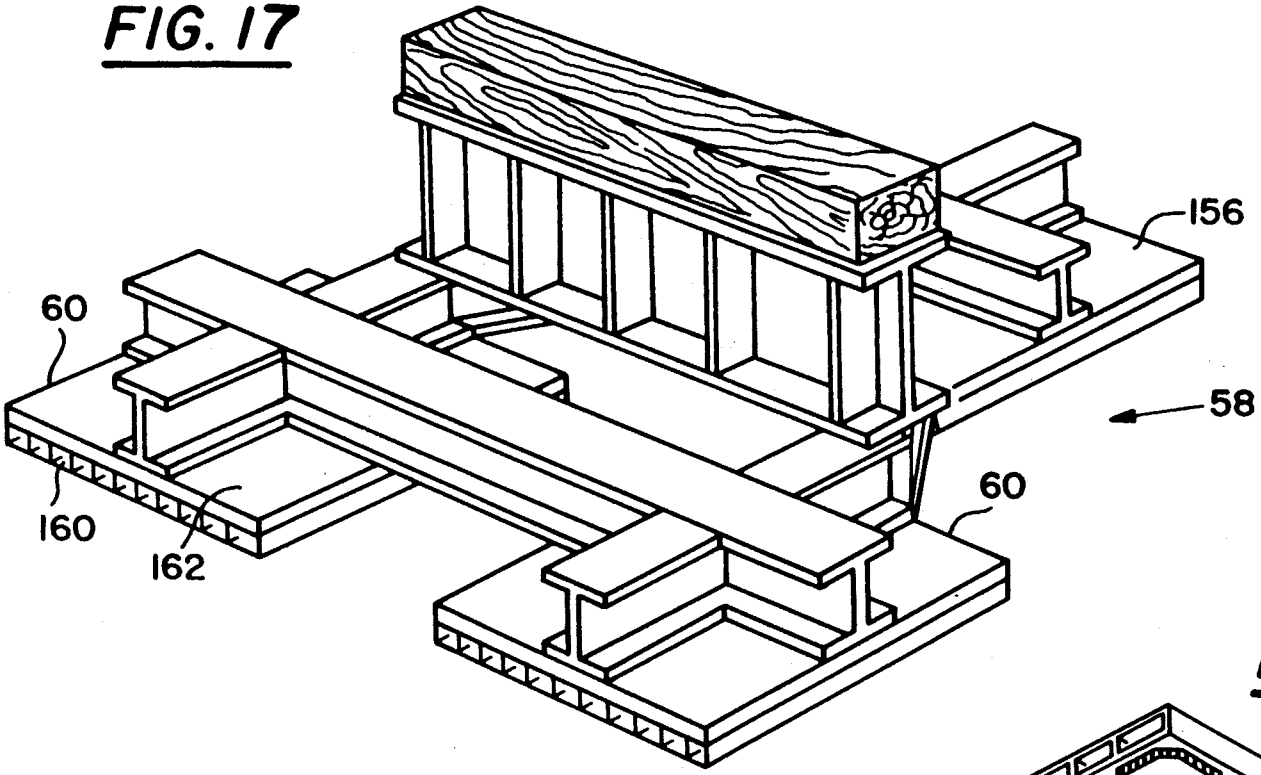
FIG. 17 is a larger scale fragmentary perspective view showing the fluid pallet device on which the module is assembled from a transverse bulkhead and double-walled subassemblies at work station #15.
Figure 18:
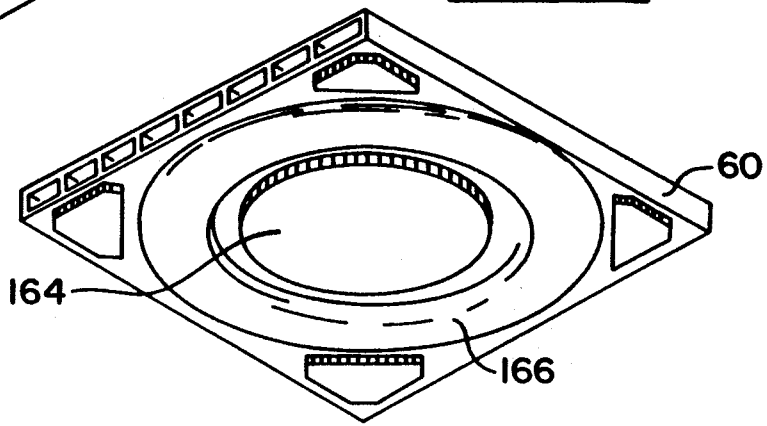
FIG. 18 is a perspective view from below showing one of the fluid cushion transfer elements of the fluid pallet transfer unit of FIG. 17.

As will be further explained below with reference to FIGS. 16 through 19, a transverse bulkhead to which subassemblies are to be assembled at work station #15 is preferably supported in region 56 on a fluid pallet transfer unit 58 (FIG. 17) the active elements of which are fluid cushion transfer elements 60 (FIGS. 17 and 18). Suffice it to say that in the region 56, the transverse bulkhead to which subassemblies are to be and being assembled and the resulting growing module can be translated and rotated about vertical axes much as if it were a Hovercraft vehicle or amusement park bumper car.

Figure 2:
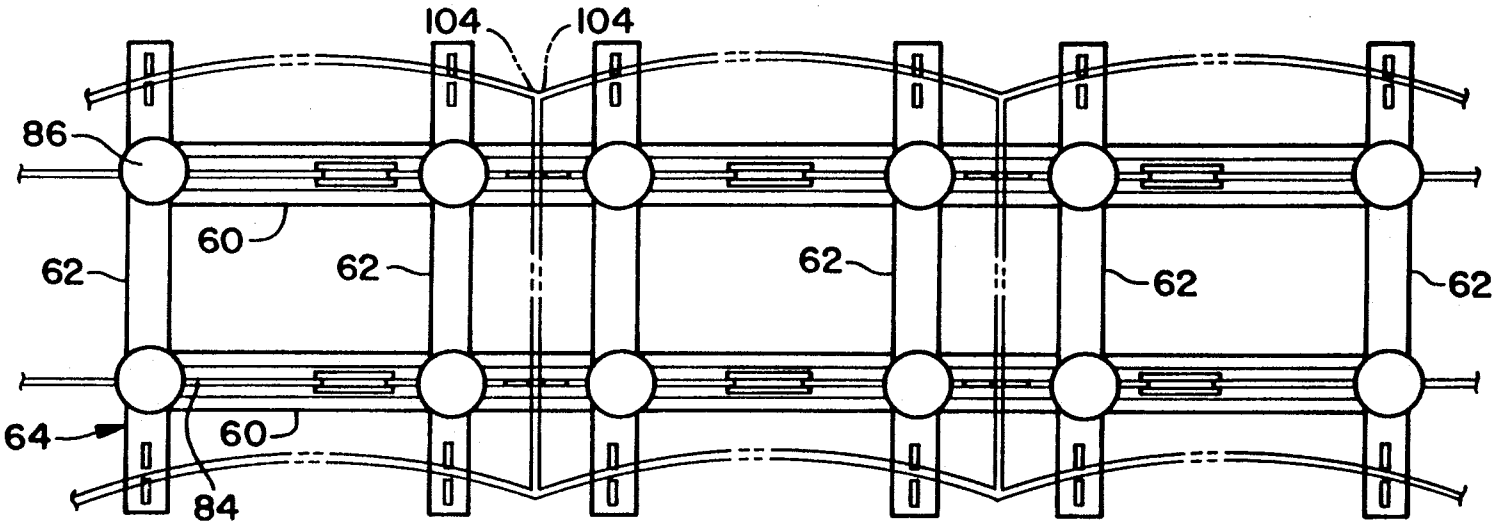
FIG. 2 is a top plan view of a bogie loaded with a complement of plates (shown in phantom lines) for fabricating a double-walled hull subcomponent for a module subassembly at work station position #1 of FIG. 1.
Figure 3:
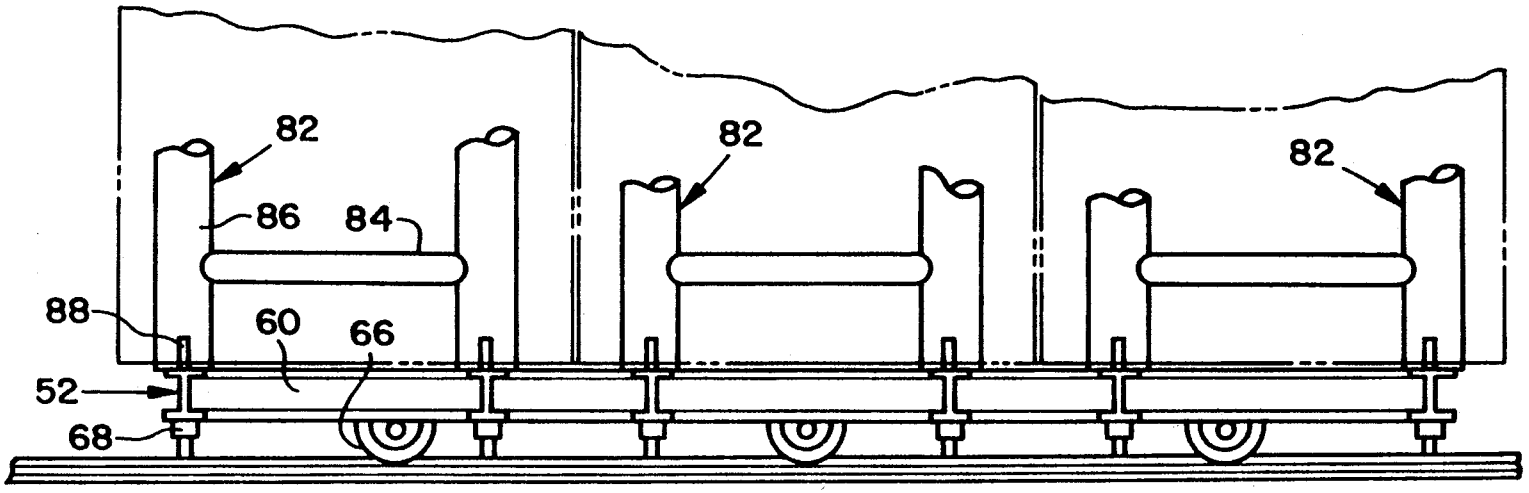
FIG. 3 is a fragmentary side elevational view of the structure depicted in FIG. 2.

Referring now to FIGS. 2 and 3, each single-width bogie 52 is shown including interconnected longitudinal beams 60 and transverse beams 62 providing a body 64 which is supported for rolling along the respective set of rails by trucks of flanged wheels 66. The bogies 52 can be immobilized against rolling, and height-adjusted by activation of lockout jacks 68 provided on the cantilevered end stubs of the beams 62, which extend transversally beyond the beams 60 (which directly overlie the rails 26, 48 or 50).

The bogies 52 further include devices for serially connecting them together in at least sets of two. Such a representative device is illustrated at 70 in FIG. 11. It is actually preferably present in other instances where bogies are shown strung together, although it is not shown.

By preference, the next larger basic unit of hull production to the individual inner (or left) wall panels 72, outer (or right) wall panels 74 and stiffened flat panels (or wall-interconnecting panels 76), is a double-walled vessel hull module subcomponent 78. By preference, the typical, principal subcomponent 78 is fabricated from three panels 72, three panels 74 and two panels 76, weldingly joined at four T-joints 80.

As present at work station #1, each bogie 52 is equipped with a sufficient complement of interior welding towers 82 (e.g., three of them for fabricating an eight-panel subcomponent). The interior welding towers are shown being constituted by respective four-legged, framework assemblies with transverse and oblique cross-bracing 84 between respective legs 86. The towers 82 are rectangular in plan. Each leg 86 is socketed on its lower end so that the legs can be properly removably positioned on the bogie by maneuvering the lower as it is lowered by crane, until the leg sockets telescopically receive respective upwardly projecting locator pins 88 secured on the bogie frame.

The bogie frame likewise has secured thereon a plurality of upwardly opening alignment chocks 90 arranged in pairs, so that as each panel 72, 74 or 76 is lowered onto the bogie, the lower edge of that panel is supported at a predetermined location at two sites that are spaced substantially along the respective lower edge of the respective panel. Accordingly, at work station #1, a component of panels 72, 74 and 76 for fabricating a subcomponent are lowered into place on a bogie 52 about the towers 82. At the sites 92 where respective T-joints 80 are going to be welded, the longitudinal edges of three panels adjoin one another. For some joints, it will be the longitudinal edges of two panels 72 and one panel 76; at others, it will be the longitudinal edges of two panels 74 and one panel 76.

At work station #2, a sufficient complement of exterior welding towers 94 are mounted on the fixed pad or foundation 96 in pairs on laterally opposite sides of the bogie rails 26. In the instance depicted, there are three interior towers 82, and six exterior towers 94. The towers 94 are constructed of welded-together pipe legs and braces, much like the interior towers 82. Although not shown in detail in the drawings of the present document, the interior and exterior towers 82, 94 have mounted on them at widely distributed locations along their heights, horizontally acting mechanically and/or fluid pressure-operated jacks which are operable manually, or from a control unit (not shown), for engaging the various panels with varied pressure on their opposite faces, for the dual purposes of jacking portions of the panels into uniform, desired juxtaposition for conducting of the joint-welding process, and for maintaining desired panel positioning throughout conducting of the welding process, despite the fact that the panels will be subjected to different stresses along their heights as the welding progresses.

Figure 4:
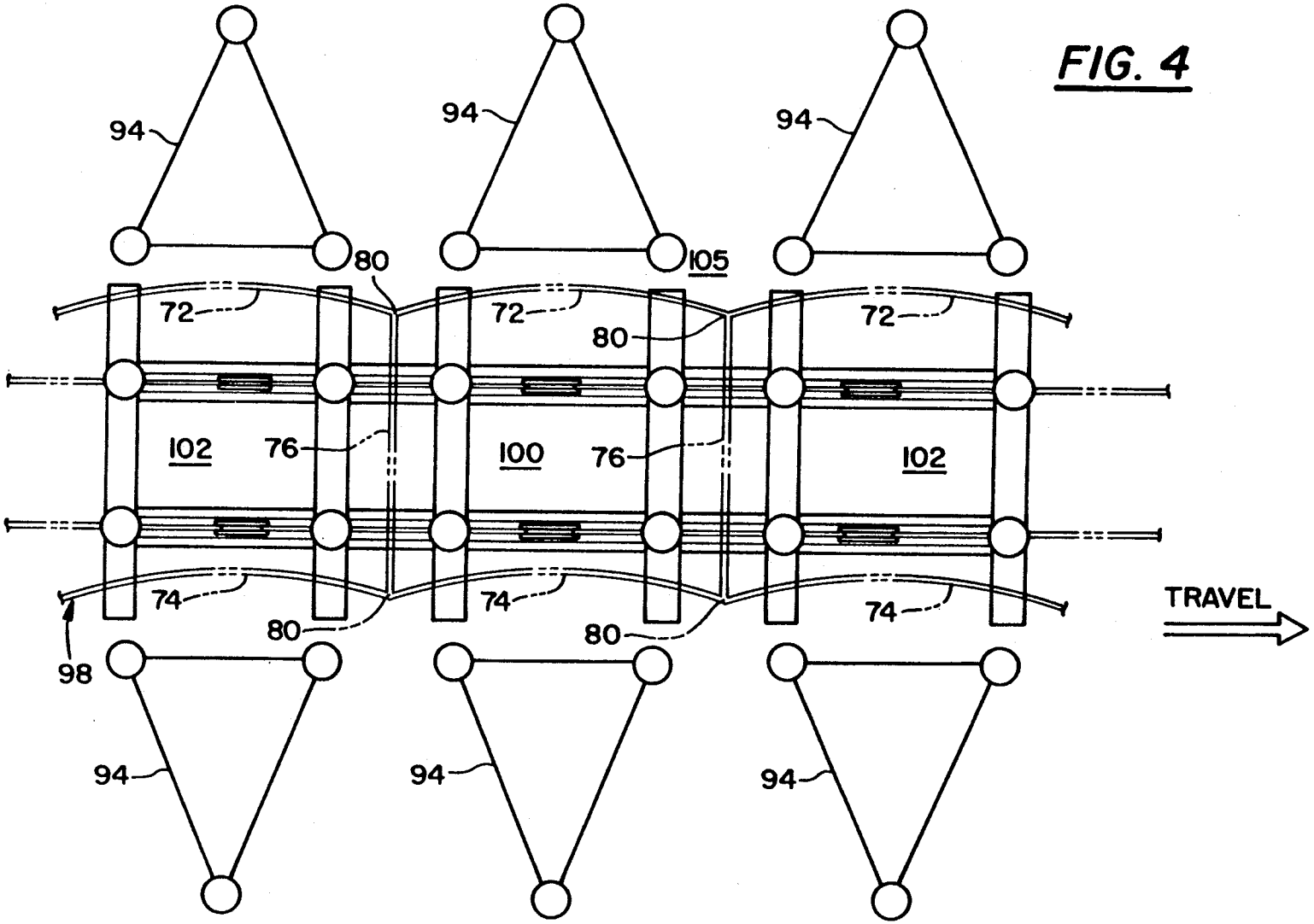
FIG. 4 is a top plan view of the loaded bogie of FIGS. 2 and 3, as rolled into work station #2, so that the interior fixture towers are flanked by respective exterior fixture towers so that T-joints can be welded at the four indicated sites where three plate edges adjoin.

As illustrated in FIG. 4, in the example depicted, four T-joints 80 are welded for uniting three panels 72, three panels 74 and two panels 76 to create a subcomponent 98. This subcomponent has one cell 100 that is completely bounded by panel surfaces on its four sides, and two partial cells 102 each of which is bounded on three sides by panel surfaces and open on one side. All are open at their longitudinally opposite (i.e., upper and lower) ends. A subcomponent could have a greater or lesser number of elements, e.g., five panels, no complete cells and two three-sided partial cells, or eleven panels, two complete cells and two three-sided partial cells, or six panels, one complete cell and one three-sided partial cell. Although, when constructing many subassemblies, all of the subcomponents will be identical, in other instances, one or more of the subcomponents may have a different number of elements than the others.

After the bogie, laden with a complement of interior towers and panels is rolled along the bogie rails from work station #1 to work station #2, it is stationed at a predetermined datum location at work station #2, and its lockout jacks 68 are extended and set, for steadying the bogie against lilting transversally of the rails. The horizontally acting mechanically and/or fluid pressure-operated jacks (not shown) on the interior and exterior towers 82, 94 are operated to engage the various panels on their opposite faces, and pressure is thereby applied to the panels for jacking them into uniform, desired juxtaposition of their respective longitudinal edges 104 which are to be welded together to form respective T-joints, and for maintaining desired panel positioning for conducting of the welding process.

The T-joints 80 (FIG. 5) are welded in work station #2 (FIGS. 1 and 4), preferably using an electroslag or electrogas welding process and apparatus, as has been further described in detail in the aforementioned U.S. Pat. No. of Cuneo et al. 5,085,161 and the aforementioned U.S. Pat. No. of Goldbach et al. 5,090,351. Electrogas welding is currently most preferred.

By preference, welding smoke is collected into the inlet end of a respective suction hose (not shown, at 105) which is positioned just above each welding head. The thus-collected contaminated air stream is processed by conventional means (not shown) for removing contaminants, before being exhausted.

After completion of the welding at work station #2, the welded joints 80 of the subcomponent thus-created are permitted to cool, whereupon exterior hydraulic and/or mechanical pressure applied by the horizontal jacking devices on the exterior towers 94 is released and the fixture carriage (bogie) 5 with its fully welded subcomponent 98 and interior towers 82 aboard, is advanced along the rails to work station #3. At work station #3, internal hydraulic and/or mechanical pressure applied by the horizontal jacking devices on the interior towers 82 is released. Preferably (and, if sufficient headroom exists at this work station, and a crane having adequate capacity is available), the interior towers 82 are withdrawn vertically upwards from the cell 100 and partial cells 102, and recycled upstream to work station #1 for installation on a bogie 52 advanced to that station. By present preference, however, the interior towers 82 remain in place past work station #3. Between work stations #2 and #4, loaded bogies may be side-transferred by transfer device 34 to buffer rail line 48 or 50. Directly or eventually, loaded bogies are advanced to work station #4 (FIGS. 1, 5 and 6) and disposed at a datum location in that work station. If needed, the jacks 68 can be extended down and set (not only at this work station, but also at any other where immobilization and steadying against transverse tipping are needed or wanted).

At work station #4, there is provided an abrasive grit applicator 106 for the laterally exposed external region of each T-joint 80. By current preference, each of the applicators 106 is an enclosed, grit-recycling rotating wheel-type abrasive grit applicator, such as an abrasive blasting wheel device available from Wheelabrator Technologies, Inc. In such a device, a stock of abrasive grit is streamed onto a rapidly rotating wheel, from which it is flung by centrifugal force through a housing outlet and impacts the surface which is meant to be cleaned. The spent abrasive collects on an apron and is returned to the feed stream to the wheel. The device may include a classifier for separating out as undersize, fragmented grit particles and small particles of paint, scale and other foreign material, and for separating out as oversize, larger chunks of abraded-off foreign material. Each device 106 is moved vertically along the region of the respective joint, thus cleaning a path which not only includes the weld itself, but panel external surfaces to the left and right of the respective joint. The actual area cleaned might be about three to ten times as wide as the weld, and extend from bottom to top of the subcomponent. The actual work can be performed in one pass or multiple passes, while the device is being lifted or lowered. The joints (four, in this instance) could be done simultaneously or serially, by as many devices 106 as desired.

In the instance depicted, each device 106 includes vertical roller tracks 108 by which the device is mounted via roller mechanism 110 to a pipe column 112. An extensible-retractable piston cylinder arrangement 114 is provided between the base plate 116 of the roller mechanism and the pipe column 112, so that, when the laden bogie is to be moved into or from work station #4, the abrasive blasting devices 106 can be temporarily rotated out of the way. Instead of being lifted and lowered by winch, the devices 106 could be adapted to crawl up and down the columns. An important factor is keeping grit away from the operating machinery. The preferred abrasive grit is made of steel, because it is durable, works well and, when spent, can be swept-up using magnetic sweeping machines.

At work station #4, another type of abrasive applicator could be used instead of a rotating wheel-type device. For instance, a pneumatic nozzle-type blaster could be used, for propelling either composition or ferromagnetic grit, and vacuum hoods used for drawing off smog-like airborne effluent from this step of the process. Spent grit which falls to the floor can be swept up manually, or using a magnetic or nonmagnetic grit sweeper. To the extent considered necessary, this work station can be shrouded for minimizing escape of grit and dust and facilitating recycling.

Figure 5:
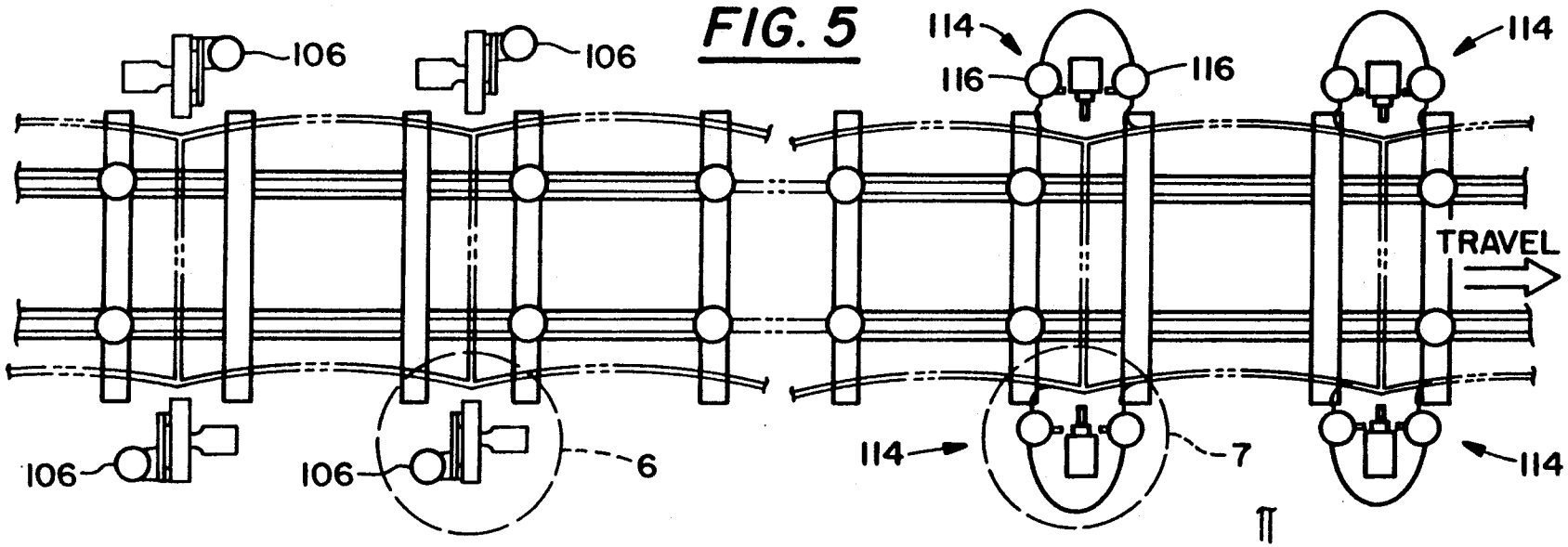
FIG. 5 is a top plan view of two successive loaded bogies respectively located at adjoining work stations #4 and #5.
Figure 6:
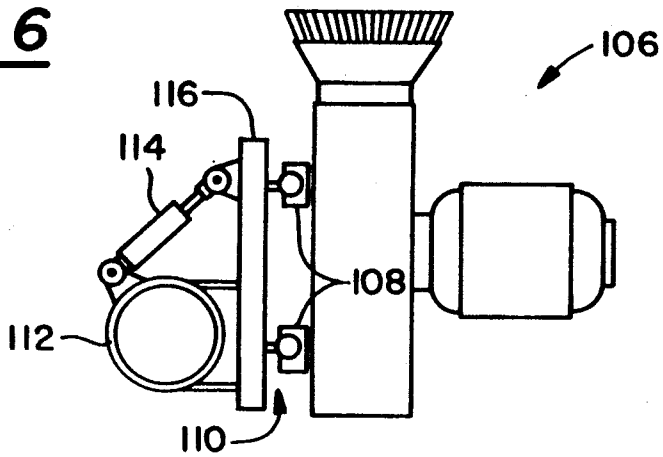
FIG. 6 is a larger scale top plan view of the abrasive blast cleaning device shown in the dashed line circle at the lower left in FIG. 5.

After the vertically extending joint locality strips have been blast-cleaned on the subcomponent at work station #4, the subcomponent-laden bogie is rolled along into a datum location at work station #5. As shown in FIG. 5, a number of bogies 52 can be adjoined or connected together as they pass through work stations #3 through #6, so that several bogies can be moved as a train to simultaneously advance all of them by one work station.

Figure 7:
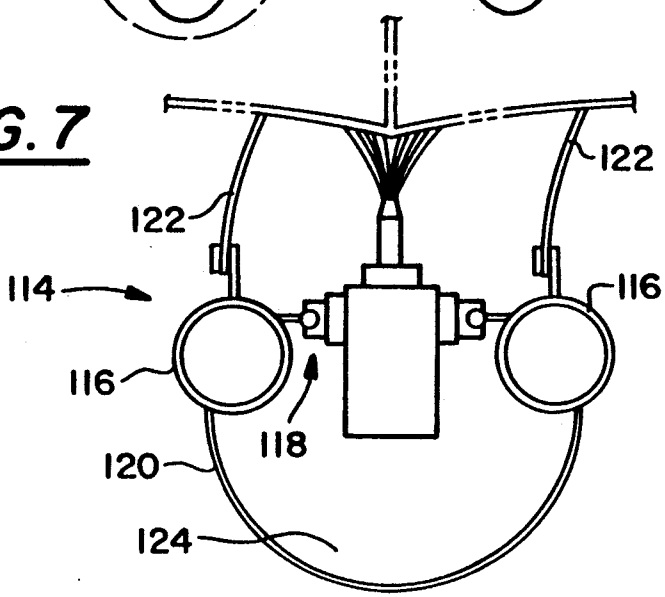
FIG. 7 is a larger scale top plan view of the coating machine that is shown in the dashed line circle at the lower right-center in FIG. 5.

At work station #5 (FIGS. 1, 5 and 7), a full complement of paint spray nozzle devices 114, preferably airless-type, are arranged to paint the strips that were cleaned off in work station #4. Thus, in the instance depicted, there are four paint applicators 114, each of which is mounted to travel up and down stationary pipe columns 116, by means of roller tracks 118. The area outside the envelope of movement of each applicator 114 is shown closed around its back by a sheet metal shroud 120, and at its left and right front edges by rubber (flexible) sweep seals (gaskets) 122, thereby creating a plenum 124 that is open only at the top and bottom. At one end, preferably the top, each plenum 124 is provided with a suction pipe for drawing off and processing the air stream passing along the plenum, to be processed for removal of paint overspray, volatile organic chemicals (VOCs), e.g., by using a conventional filtering through activated charcoal or the like, and incineration, before release of that air stream to the atmosphere.

Figure 8:
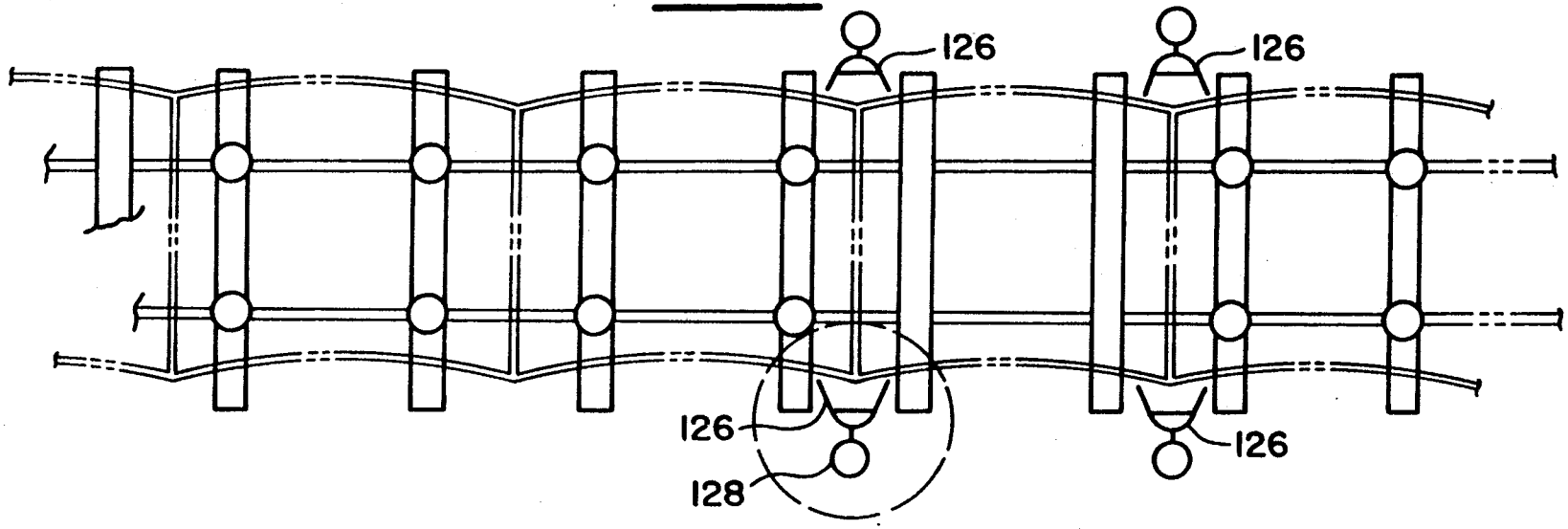
FIG. 8 is a top plan view of part of a loaded bogie in work station #5 and of a loaded bogie in work station #6.
Figure 9:
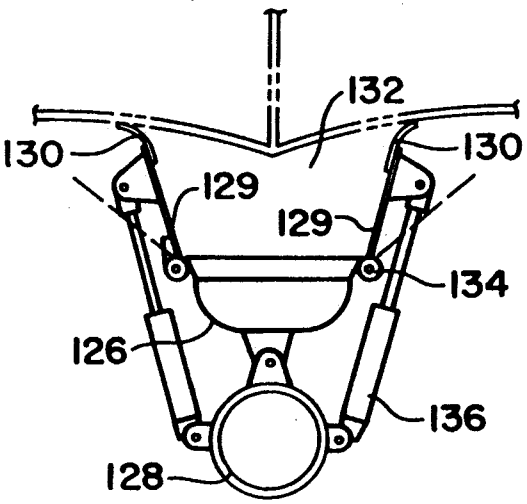
FIG. 9 is a larger scale top plan view of the coating-curing device that is shown in the dashed circle at the lower central region in FIG. 8.
Figure 10:
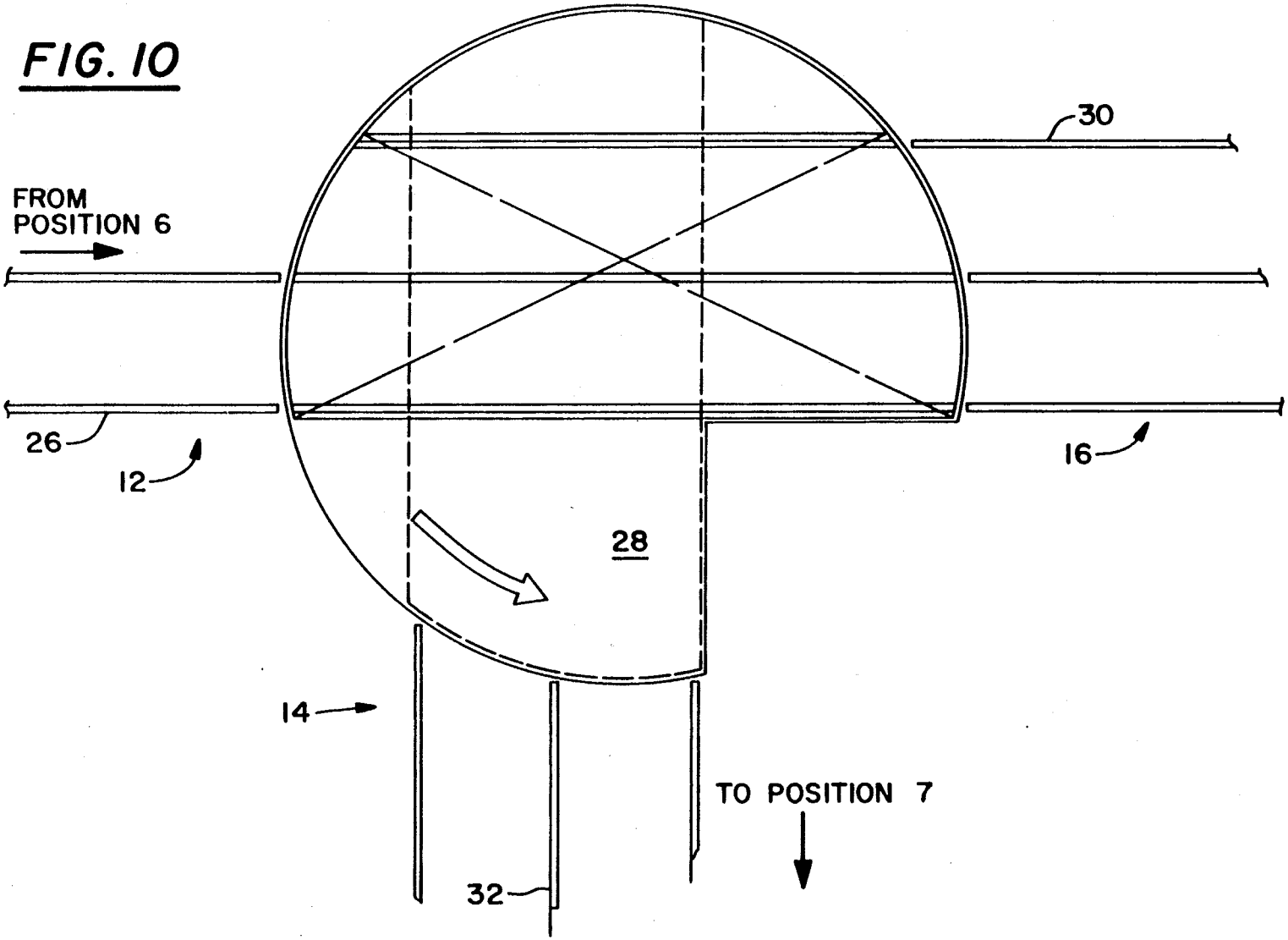
FIG. 10 is a top plan view of the bogie track turntable site that is located between work stations #6 and #7.

Referring now to FIGS. 1, 8 and 9, the next work station is work station #6, at which the coating applied at work station #5 is cured. (It would be possible to combine work stations #5 and #6 into one physical location, so that each strip of coating would be cured within the same plenum in which it was applied. However, it is preferred that the coating and curing be conducted at successive, spatially separated stations, so that work may be begun on coating the cleaned joint strips on a succeeding subcomponent, while the coated strips on a preceding subcomponent are being cured.

The nature of the cure will depend on the nature of coating. By present preference, the coating is one that cures upon application of thermal energy thereto in the infra-red band of wavelengths, e.g., using for each strip a respective horizontally aimed, vertically extending single column bank of infra-red heat lamps 126. The heat lamps 126 are shown supported on respective vertical columns 128, with locations corresponding to those of respective coated joint strips when the subcomponent-laden bogie is correctly located at a datum position at work station #6. Each bank of heat lamps, as it operates, causes some volatile organic chemicals to boil off (evaporate) from the curing coating. In order to trap them for removal, each heat lamp bank mounts left and right flap panels 129 which have front edge flexible seal strips 130 which engage the respective external surface of the respective subcomponent, to the left and right, respectively, of the respective coated joint strip while curing is taking place. Thus, a curing plenum 132 is provided for each heat lamp bank. As with the other work stations where airborne effluent collection takes place, each plenum 132 is open at one end (e.g., the lower end) for entrance of an air stream, and at the opposite end (e.g., the upper end) is provided with an inlet end of a suction hose which draws off the effluent in an air stream, for separation by filtration and combustion of the effluent.

In order to facilitate movement of a subcomponent-laden bogie to and from work station #6, the flap panels 129 are preferably hingedly mounted at 134 to the heat lamp banks, and are position controlled by operating extensible-contractible piston-cylinder arrangements 136 pivotally connected between respective flap panels and the respective support columns 128.

If the panel/subcomponent-laden bogies are hitched together while passing through work stations #1 through #6, at each time when the subcomponent-laden bogie at work station #6 is to be advanced to work station #7, it must be decoupled and advanced on its own, because (in the particular exemplary layout depicted) there is a right-angle turn in the track between work stations #6 and #7. In order to accommodate such a turn within a small space, the turntable 28 is provided. Accordingly, a subcomponent-laden bogie to be advanced from work station #6 to work station #7 is advanced onto the turntable 28, the turntable is then turned through 90 degrees, and then the subcomponent-laden bogie on the turntable is advanced off the turntable 28, and along the rails 32 of assembly line central arm 14, and into a datum location at work station #7.

Pausing now in the description of the fabrication process taking place along the main arms 12 and 14 of the assembly line 10, a description will be given of the steps taking place on the right auxiliary arm 16 of the assembly line 10. Here, at work stations which may or may not be located on the track and use bogies, curved subcomponents (for the "corners" of subassemblies) are fabricated in a series of steps at a series of work stations #2' and #4' through #6', which are equivalent to and carry out corresponding steps which have been described above in relation to work stations #2 and #4 through #6, respectively.

In the preferred embodiment, the main difference is that at work station #2' (which is shown provided in mirror-image duplicate, the wide ends of two corner subcomponents fabricated at respective ones of these being later joinable, at work station #14), the interior towers are preferably fixedly mounted on the building foundation, rather than removably mounted on a bogie. Accordingly, at each of work stations #2', the respective coated panels for a corner subcomponent are uniformly positioned in chocks mounted on the foundation, horizontal pressure-applying jacks are set to conform and hold the panels, and T-joints are electrogas welded. After the joints of a resulting subcomponent cool, the jacks are released and the corner subcomponent 138 is lifted free of the interior and exterior towers and onto a respective double-width bogie 54 at the right end of the track 16. This corner subcomponent-laden double-width bogie is then successively advanced leftwards in a series of moves, to datum positions at each of work stations #4', #5' and #6', at which the welded T-joint strips on the corner subcomponent 138 are first externally abrasive blast-cleaned (at work station #4'), then coated (at work station #5'), and then coating-cured (at work station #6'). The reason why double-width bogies are used for the corner subcomponents, is that they are transversally wider than the subcomponents 98, and so need a broader support to protect against unwanted transverse tilting over while being advanced along the assembly line.

At its left end, the arm 16 of the assembly line intersects the turntable 28, the tracks of which are positionable to align with any of the three branches 12, 14, 16 of the assembly line. Accordingly, a corner subcomponent-laden double-width bogie can be run leftwards onto the turntable 28 and turned out onto the central arm 14, which, as illustrated, also consists of double track, so as to accommodate serially interspersed with one another, both subcomponent-laden single-width bogies 52 and corner subcomponent-laden double-width bogies 54.

Now, discussion of what happens in the fabrication process beginning at work station #7 is resumed.

At work station #7, regular subcomponents 98 and subcomponents 138 on successive bogies 52 and 54 are serially weldingly joined, in desired combinations, for fabricating respective module subassemblies 140. Each typically is made of several subcomponents 98, with a corner subcomponent 138 at each end, and added wall interconnecting panels 72 where each two adjoining subcomponents of either type are joined by two T-joints (one in the outer or right wall and the other in the inner or left wall).

Accordingly, if interior towers 82 were removed from the respective partial cells 102 at work station #3 (or comparably between work stations #2' and #4') corresponding replacements are installed at work station #7. Also at this work station, flanking the track 32, two pairs of exterior towers 142. These are substantially like the exterior towers 94 provided at work station #2. They are correspondingly located to act cooperatively with the internal towers disposed in partial cells of two serially adjoining subcomponents on two serially adjoining bogies, by activation of respective horizontally acting jacks, to correctly position and hold the three longitudinal edges of the respective two panels 72 and added panel 76, and the three longitudinal edges of the respective two panels 74 and added panel 76 so that electrogas welders (located at 144, and constructed and operated as described in relation to the welders at work station #2, though not shown) are operated on opposite sides, at the track, to create the respective two T-joints, whereupon the jacks are released and the bogies are advanced, and this joining step repeated until all of the subcomponents for a subassembly thereby have been welded together, with a panel 76 added at each pair of joints, thereby converting two adjoining partial cells 102 into two respective perimetrically complete cells 100.

Figure 11:
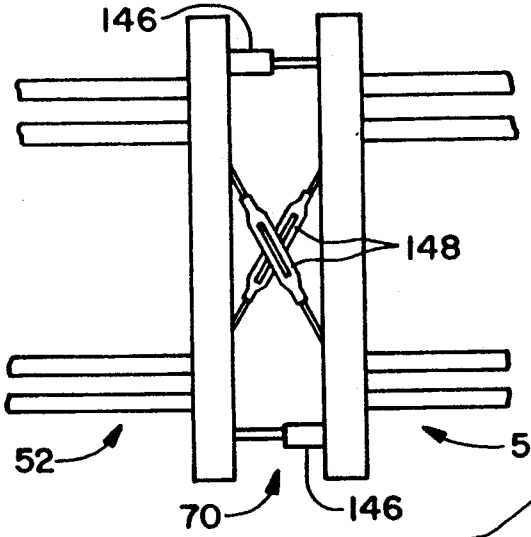
FIG. 11 is a fragmentary to plan view showing the coupling device between two bogies, which is useful in work station #7 for adjusting the positioning of adjoining subcomponent ends, so that they can be welded together for fabricating subassemblies from subcomponents.
Figure 12:
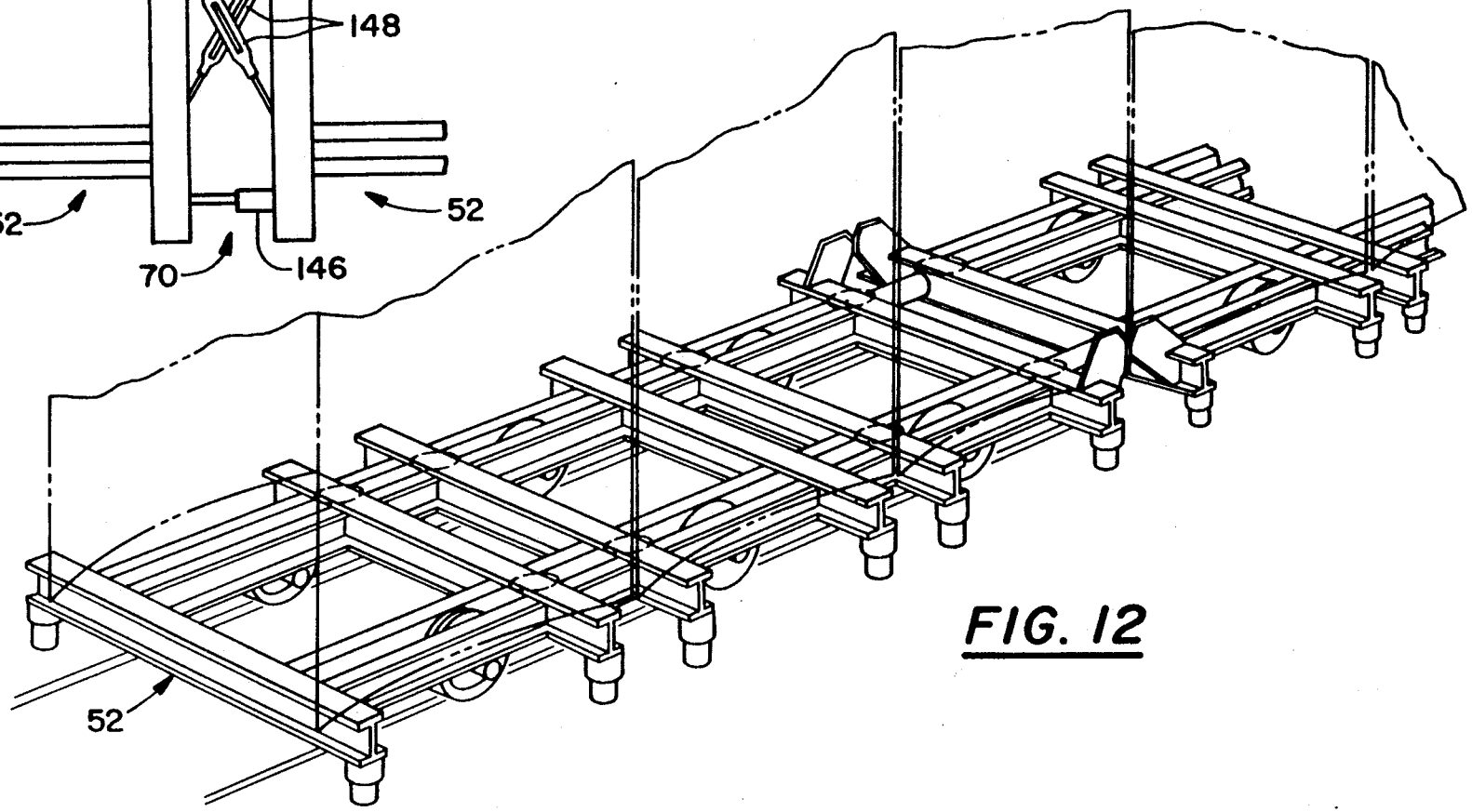
FIG. 12 is a fragmentary perspective view showing one loaded bogie and part of another, coupled together at work station #7.
Figure 13:
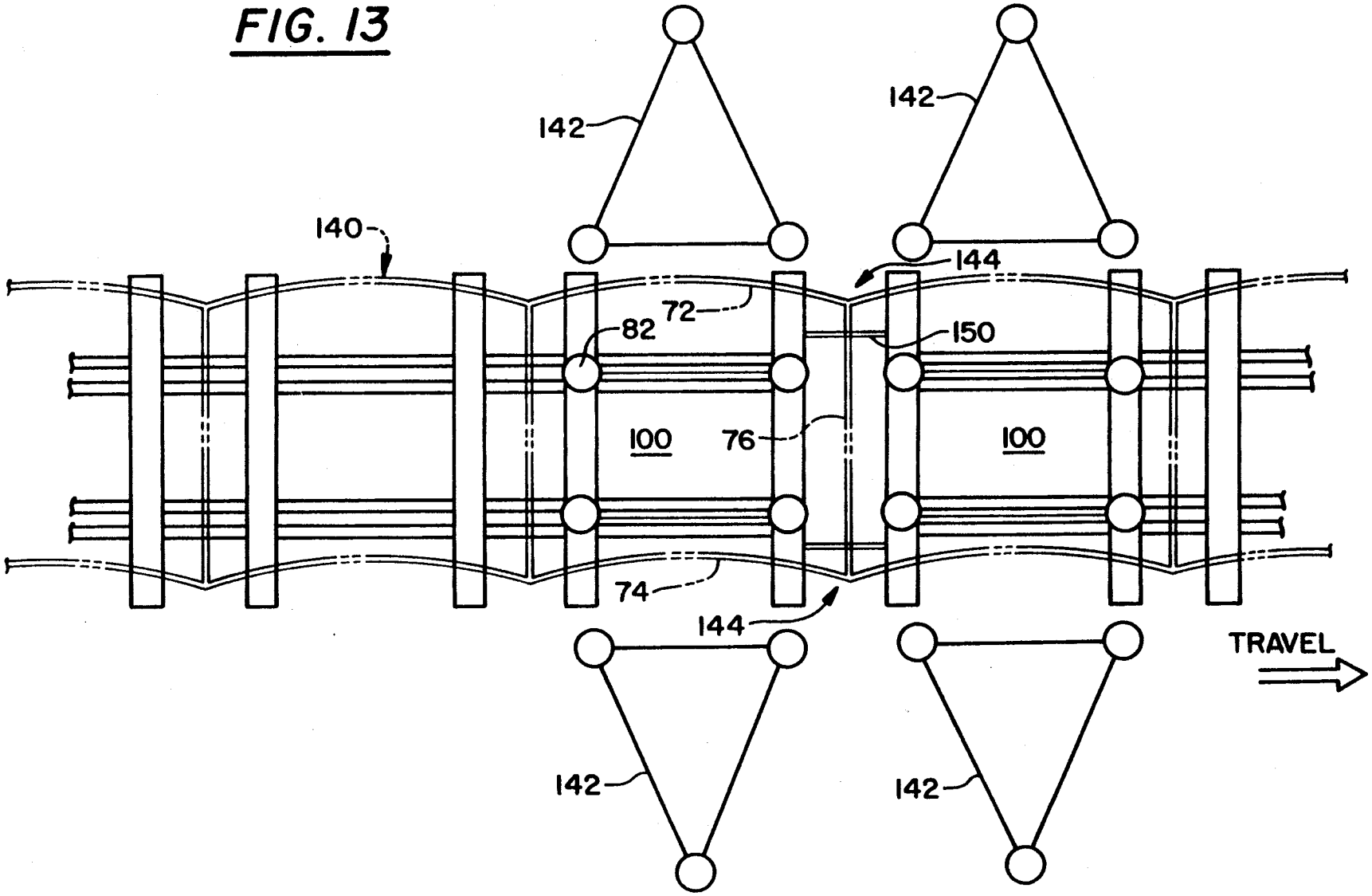
FIG. 13 is a top plan view of the structure shown in FIG. 12 at work station #7.
Figure 14:
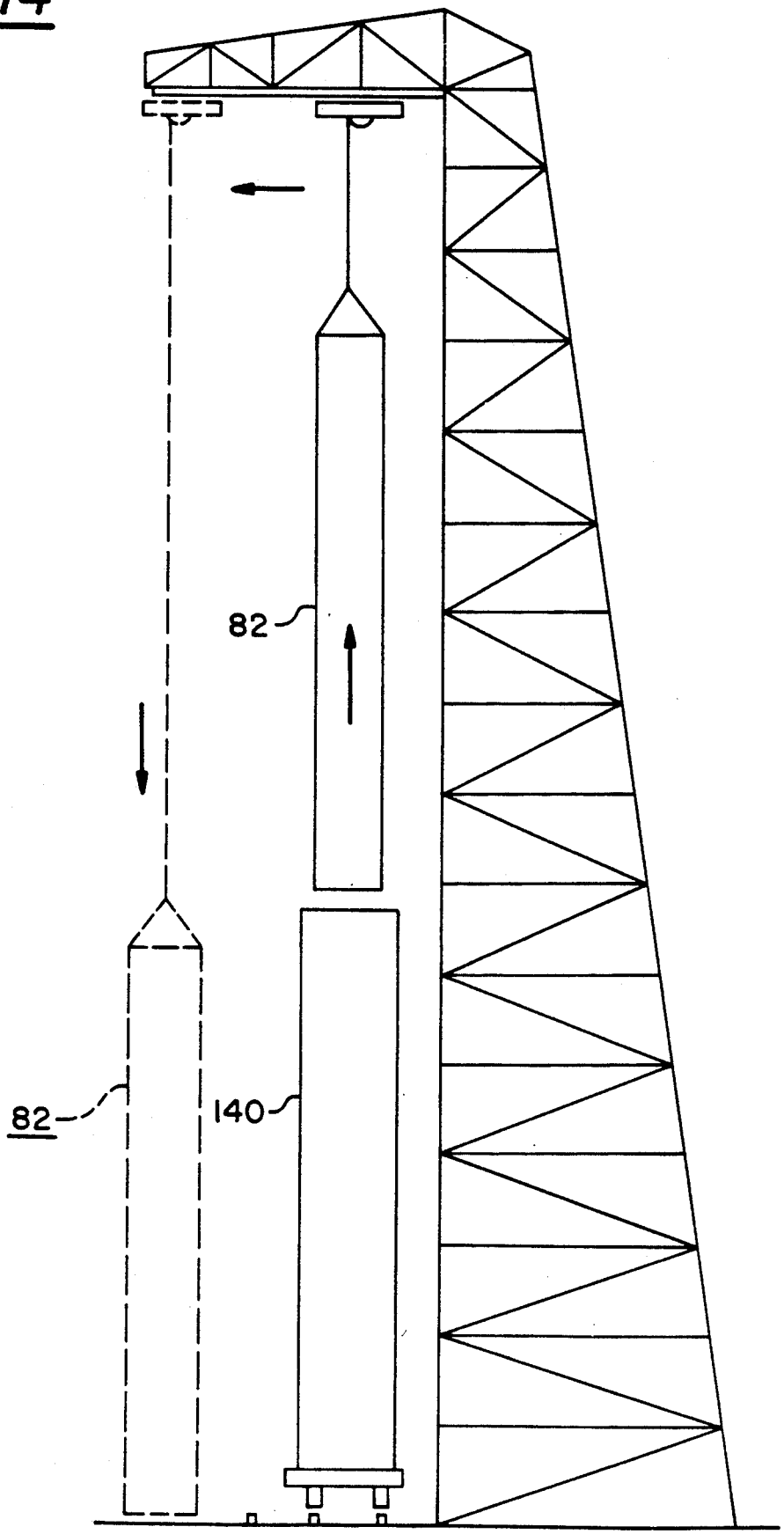
FIG. 14 is a smaller scale schematic elevational view, showing an interior welding tower being lifted out of a cell of a subassembly at work station #3 or at work station #9.

Referring to FIGS. 11, 12 and 13, some structure is illustrated that is useful in work station #7 for the subcomponent-to-subcomponent joining step. First, the bogie-connecting device 70 which connects two bogies during the joining step includes extensible-contractible fluid pressure-operated piston and cylinder-type jacking devices 146 (or equivalents), for which can be operated to push and pull the two bogies longitudinally away from and towards one another and, if needed, slightly to angle them relative to one another about a vertical axis. Second, the bogie-connecting device 70 further includes oblique cross-connecting sets of turnbuckles 148, the selective tightening of which can pull the respective end of the leading or trailing connected bogie transversally along a horizontal axis, for correctly lining up and drawing into uniform juxtaposition the panel edges which are to be welded together at work station #7 in any particular T-joint creation step.

Chocks for holding the lower edges of the stiffened flat panel 76 which is put into place between two bogies each time the T-joint creation step is to be conducted at work station #7 conveniently may be provided on a fixture 150 that is cooperatively supported between the neighboring ends of the respective connected bogies.

After the T-joint creation step is practiced at work station #7 to serially join two subcomponents (i.e., either two regular subcomponents, or one regular subcomponent to the narrower end of a corner subcomponent) and the horizontal jacks of the interior and exterior towers are released, the lockout jacks 68 are retracted and the train of bogies are advanced by one car length. A further subcomponent-laden bogie is brought around on the turntable 28 from the respective assembly line arm 12 or 16, and joined by its connecting device 70 to the trailing end of the train of bogies, thereby bringing a new subcomponent-to-subcomponent interface to the datum position for welding in work station #7 and a bogie further forward in the train to work station #8.

At work station #8, each interior tower 82 is lifted out of the cell 102 (converted to 100) it had been occupying, and recycled up the assembly line for reuse.

At work stations #9, #10 and #11, the T-joint strips of the subcomponent-joining T-joints created in work station #7 are successively externally blast-cleaned (at work station #9), coated (at work station #10) and coating-cured (at work station #11) using equipment and procedural steps which are substantially like those which have been described above in relation to work stations #4, #5 and #6.

Figure 15:
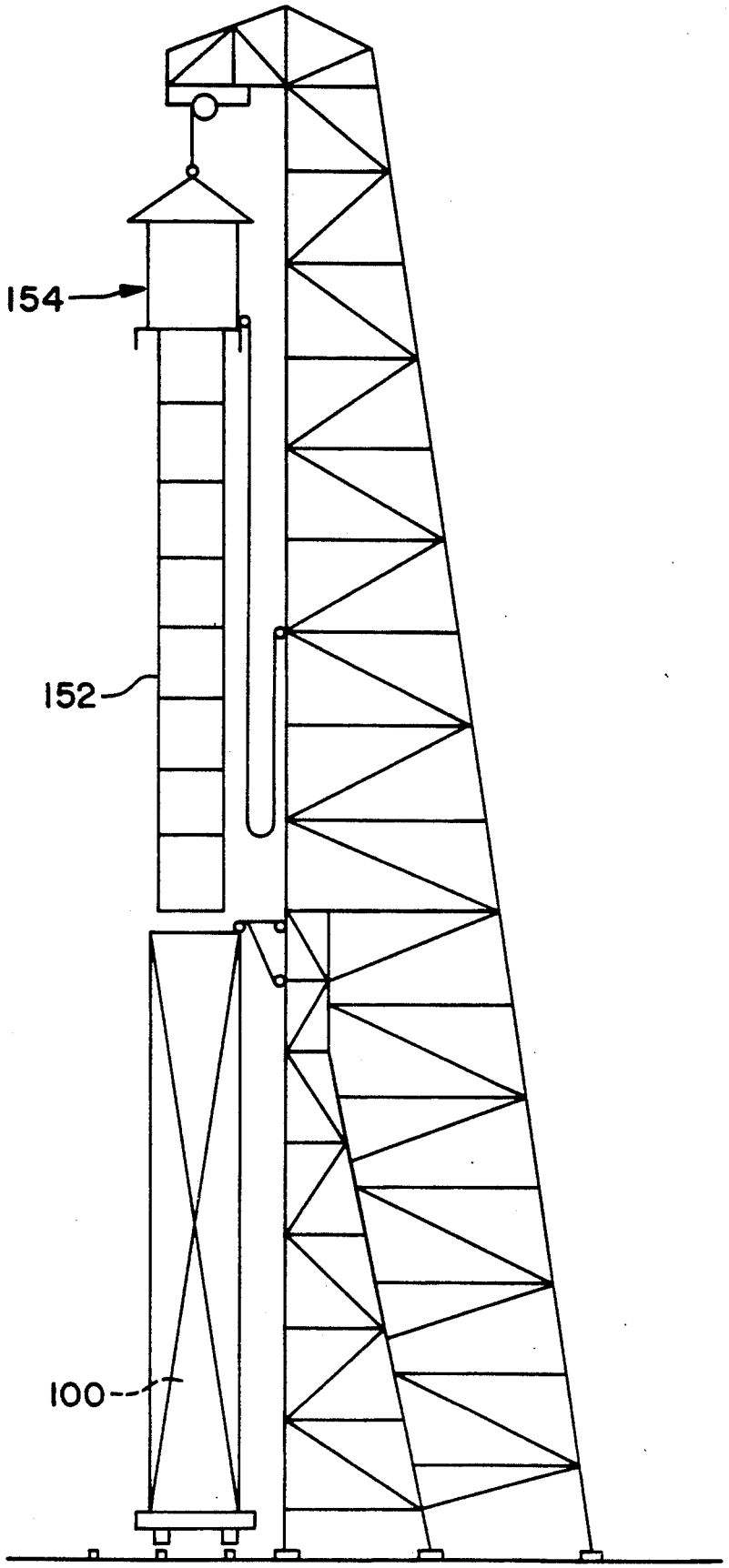
FIG. 15 is a schematic elevational view, showing an interior blast cleaning tower being lowered into or lifted out of a cell of a subassembly at work station #12 (as representative also of the painting and curing work that is conducted at work stations #13 and #14.

Then, at work stations #12, #13 and #14, the internal corner strip regions within the cells 100, where the panel coatings were disrupted by conducting the welding steps at work stations #2 and #7, are successively blast cleaned (at work station #12), coated (at work station #13) and coating-cured (at work station #14) by successively lowering into each cell 100 (as typically illustrated in FIG. 15) a specialized interior tower 152. Actually, several towers 152 preferably are provided, so that they may be leap-frogged down the line, then recycled back to the head of the line, at their respective work stations. Among the specialized interior towers 152, at least one is equipped with four abrasive blasting applicators as have been described above with reference to work station #4, at least one is equipped with four coating applicators as have been described above with reference to work station #5, and at least one is equipped with four coating-curing means as have been described above with reference to work station #6. (Inasmuch as each cell 100 constitutes a parametrically enclosed plenum, separate plenums need not be provided for the work applicators at the four corners of each specialized interior tower 152. Rather, air flow may be drawn in through one end of each cell 100 while a specialized interior tower 152 is in use, and out through a suction hose inlet 154 which leads the resultingly contaminated air stream to a facility for filtration and combustion of airborne effluent, as has been described above in relation to work stations #4, #5 and #6.)

Inasmuch as work stations #8 (partially) through #15 are preferably located outside the assembly building represented by the wall 18 and portal 20, there is some chance that a strong gust of wind could topple the upended subcomponents, growing subassemblies, and completed subassemblies on the train of bogies. To prevent that from happening, and also to help transfer bogie-advancing power to the train for moving it stage-by-stage through each exterior work station, the support structure 44 is mounted to extend alongside the track 32 through work stations #8 through #15, and travelling guides 46, which are mounted to the support structure, are constructed and arranged to advance therealong, suitably disconnectably connected to the support structure 44 and to respective ones of the subcomponents, growing subassemblies and subassemblies at a substantial height above the fixed pad or foundation 96.

Transverse bulkheads 156 may be constructed at an adjacent facility (not shown) using the techniques, materials, design and principles that are disclosed in the above-identified U.S. Pat. Nos. of Cuneo et al. 5,085,161 or Goldbach et al. 5,090,351, then transferred, as needed, to the region 56 beside work stations #8 through #15.

Referring to FIGS. 16 through 19, in the region 56, each transverse bulkhead 156 preferably is supported so as to extend horizontally, one face upwards, on a respective fluid pallet transfer unit 58, each of which has a frame 158 on which the respective bulkhead 156 rests, and a multiplicity of downwardly facing fluid cushion transfer elements 160, each of which includes a pallet plate 162 having foot-like landing pads 16 by which the pallet plate supports the frame 158 on the fixed foundation 96 in the region 56 when the fluid pallet transfer unit is at rest, and a fluid cushion 166 into which pressurized fluid is pumped when the frame is intended to levitate above the foundation 96 at 56 so that the position of the respective unit 58 and whatever structure it is carrying, can be easily shifted all together. In this manner, a transverse bulkhead 156 is shifted about in a horizontal plane in order to bring successive increments of its periphery into correct juxtaposition with a respective completed subassembly 140 at the work station #15. Each time a correct juxtaposition is achieved, it is maintained while the lower end of the respective subassembly is welded (e.g., by conventional welding techniques) to a respective portion of the periphery of the respective transverse bulkhead. After the first such subassembly is welded to the transverse bulkhead 156, each subsequently added subassembly not only has its lower end welded to the transverse bulkhead along a respective portion of the periphery of the transverse bulkhead, but also has vertical T-joints welded (with insertion of a wall-interconnecting panel 76 between each two perimetrically adjacent subassemblies 140, and the welded incorporation of its two longitudinal edges into the respective T-joints).

Interior and/or exterior towers, and chocks of the types disclosed above can be used at this stage in and/or flanking the respective partial cells 102 where subassemblies need to be weldingly joined and panels supported, for jacking and holding respective panels while they are welded at respective T-joints, and then for blast-cleaning, coating, and coating-curing the respective T-joint strips, both internally and externally of the growing module, airborne effluent being collected and processed as described above.

By current preference, each transverse bulkhead is constructed in two complementary halves, namely a port side and a starboard side. These bulkhead members are provided with full complements of subassemblies about their respective outer-peripheral edges, in order to thereby create port and starboard module halves. Finally, the module halves are welded to opposite longitudinal edges and lower end edges of a longitudinal bulkhead (not shown) as disclosed in the aforementioned U.S. Pat. No. of Goldbach et al. 5,086,723 and/or the aforementioned U.S. patent application No. of Goldbach 07/953,141. As disclosed in such patent and application, the longitudinal bulkhead may preferably include a fully outfitted keel and deck girder subassemblies along its longitudinally opposite ends, so that these become incorporated in the module along the longitudinal centerline plane of the module.

The completed module may be launched into the water, and further manipulated and serially joined to others similarly constructed, and that longitudinal midbody structure to bow and stern sections to create a double-walled vessel hull, as has been described in more detail in the above-referenced earlier U.S. patents and patent applications.

It should now be apparent that the improved method and apparatus for fabricating double-walled vessel hull midbody modules as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A method for fabricating at least one subcomponent for a module of a double-walled vessel hull, comprising:

(a) providing a rollable bogie with chocks for supporting the lower edges of a plurality of upended hull plate panels in a predetermined spatial relation;

(b) disposing on said bogie a full complement of upended hull plate panels having lower edges thereof supported in respective ones of said chocks, said full complement including at least two wall panels for a same first wall of the hull, and at least one wall-interconnecting panel for connecting said first wall with a second wall of the hull, said two wall panels and one wall-interconnecting panel collectively having three substantially vertically extending longitudinal edges spatially juxtaposed adjacent one another at a respective T-joint creation site;

(c) providing at least two interior towers on said bogie, including one for each cell or partial cell that will be created by welding together said full complement of panels at each said T-joint creation site;

(d) rollingly advancing said bogie along a track into a work station which includes a full complement of exterior towers flanking said track so that each wall panel is sandwiched between a respective interior tower and a respective exterior tower;

(e) activating horizontally acting jacks on said interior and exterior towers to positionally adjust and hold said wall panels and each said wallinterconnecting panel, so that all three panel longitudinal edges at each T-joint creation site are uniformly spaced from one another;

(f) welding a T-joint at each T-joint creation site thereby uniting said full complement of plates into a subcomponent;

(g) deactivating said horizontally acting jacks on said exterior towers; and (h) rollingly advancing said bogie with said subcomponent supported thereon along said track into a further work station.

2. The method of claim 1, wherein:

said welding is conducted using an electrogas welder for each T-joint.

3. The method of claim 2, wherein:

welding smoke evolving from each T-joint creation site as the respective T-joint is being welded, is captured in an air stream, and said air stream is then processed for removing smoke constituents therefrom.

4. The method of claim 1, wherein:

said full complement of upended hull plate panels includes three wall panels for said first wall of said hull, three wall panels for said second wall of said hull, and two wall-interconnecting panels, so that there are four said T-joint creation sites, three said interior towers, six said exterior towers, and one said cell.

5. The method of claim 4, further including:

(i) at said further work station, blastingly applying abrasive grit exteriorly to said subcomponent so as to clean a strip for each said T-joint which includes a weld and flanking regions to the left and right of such weld along substantially the full vertical extent of said subcomponent.

6. The method of claim 5, further comprising:

collecting airborne effluent and spent grit from the abrasive grit-applying step, and classifying the spent grit to remove undersize and oversize particles, and recycling non-oversize, non-undersize grit particles to said abrasive grit-applying step.

7. The method of claim 5, further including:

(j) rolling the subcomponent-laden bogie, after providing each said clean strip, to a next work station, and, at such next work station, coating each said clean strip with a protective coating.

8. The method of claim 7, further comprising:

collecting airborne effluent from the coating applying step in an air stream, and filtering such air stream and subjecting such air stream to a combustion step for removing coating overspray and volatile organic chemicals therefrom.

9. The method of claim 7, further comprising:

(k) rolling the subcomponent-laden bogie, after coating each clean strip, to a next work station, and, at such next work station, curing said coating on each said coated strip.

10. The method of claim 9, further comprising:

collecting airborne effluent from the coating-curing step in an air stream, and subjecting such air stream to a combustion step for further removing volatile organic chemicals therefrom.

11. The method of claim 9, further comprising:

(1) repeating steps (a)-(k) a plurality of times on further said hull plates, using respective further said bogies, and thereby providing a plurality of said subcomponents;

(m) serially weldingly joining said subcomponents, in sets, to provide a plurality of subassemblies;

(n) providing two complementary starboard-side and port-side transverse bulkhead members each having an inner edge and an outer-peripheral edge, and each disposed so as to extend horizontally;

(o) rollingly advancing each subassembly into juxtaposition with a respective outer-peripheral portion of a respective transverse bulkhead member and such portion weldingly joining such subassembly along a lower end thereof to the respective bulkhead member, thereby surrounding said outer-peripheral edge of each said bulkhead member with subassemblies;

(p) weldingly joining corresponding longitudinal edges of corresponding panels of corresponding hull walls to one another about each bulkhead member, thereby creating two complementary module halves;

(q) arranging a longitudinal bulkhead medially between said bulkhead members and module halves; and weldingly joining said inner edges of said bulkhead members to said longitudinal bulkhead; and (r) weldingly joining corresponding longitudinal edges of corresponding panels of corresponding hull walls of said module halves to said longitudinal bulkhead, thereby providing a module.

12. The method of claim 4, further including:

releasing respective horizontally acting jacks and upwardly withdrawing a respective said interior tower from said cell; and successively abrasive blast cleaning, coating and coating-curing all of four T-joint strips at four respective corners within said cell.

13. The method of claim 11, further including:

at each of steps (m) and (p) inserting wall interconnecting panels respectively between subcomponents being weldingly joined to one another, and between subassemblies being joined to one another, thereby dividing respective pairs of confronting partial cells into respective pairs of perimetrically complete cells.

14. Apparatus for fabricating at least one subcomponent for a module of a double-walled vessel hull, comprising:

a track extending through a plurality of work stations;

a rollable bogie having chocks thereon for supporting the lower edges of a plurality of upended hull plate panels in a predetermined spatial relation, so that a full complement of upended hull plate panels can be supported on said bogie with the lower edges thereof supported in respective ones of said chocks, said full complement including at least two wall panels for a same first wall of the hull, and at least one wall-interconnecting panel for connecting said first wall with a second wall of the hull, said two wall panels and one wall-interconnecting panel collectively having three substantially vertically extending longitudinal edges spatially juxtaposed adjacent one another at a respective T-joint creation site;

at least two interior towers on said bogie, including one for each cell or partial cell that will be created by welding together said full complement of panels at each said T-joint creation site;

a work station along said track which includes a full complement of exterior towers flanking said track so that, when said bogie laden with said panels and said interior towers is rolled along said track into said work station, each wall panel is sandwiched between a respective interior tower and a respective exterior tower;

horizontally acting jacks provided on said interior and exterior towers which are actuatable to positionally adjust and hold said wall panels and each said wall-interconnecting panel, so that all three panel longitudinal edges at each T-joint creation site are uniformly spaced from one another;

welding means for welding a T-joint at each T-joint creation site thereby uniting said full complement of plates into a subcomponent, whereupon said horizontally acting jacks on said exterior towers can be deactivated; and said bogie with said subcomponent supported thereon along said track rollingly advanced into a further work station along said track.

15. The apparatus of claim 14, wherein:

each said welding means is an electrogas welder.

16. The apparatus of claim 15, further including:

means for capturing welding smoke evolving from each T-joint creation site as the respective T-joint is being welded in an air stream, and for processing said air stream for removing smoke constituents therefrom.

* * * * *